US005675877A

United States Patent [19]

Lewis

[11] Patent Number: 5,675,877

[45] Date of Patent: Oct. 14, 1997

[54] DISH ASSEMBLY FOR BURIAL CASKET CAP AND METHOD

[75] Inventor: Wade A. Lewis, Fairfield, Ohio

[73] Assignee: Batesville Casket Company, Inc., Batesville, Ind.

[21] Appl. No.: 511,517

[22] Filed: Aug. 4, 1995

[51] Int. Cl.[6] ..... A61G 17/00

[52] U.S. Cl. ..... 27/19; 27/14; 27/15; 27/16; 27/2

[58] Field of Search ..... 27/14, 18–19

[56] References Cited

U.S. PATENT DOCUMENTS

| | | | |
|---|---|---|---|
| 1,931,828 | 10/1933 | Overstreet | 27/19 |
| 2,044,967 | 6/1936 | Bowler | 27/19 |
| 2,947,059 | 8/1960 | Hillenbrand | 27/19 |
| 3,077,016 | 2/1963 | White | 27/19 |
| 3,157,936 | 11/1964 | Hillenbrand | 27/19 |
| 3,228,085 | 1/1966 | Nelson | 27/19 |
| 4,312,104 | 1/1982 | Baker et al. | 27/19 |
| 4,357,741 | 11/1982 | Winburn et al. . | |
| 4,639,985 | 2/1987 | Craft | 27/19 |
| 5,495,648 | 3/1996 | Rojdev | 27/19 |

*Primary Examiner*—Carl D. Friedman
*Assistant Examiner*—Beth A. Aubrey
*Attorney, Agent, or Firm*—Wood, Herron & Evans, P.L.L.

[57] ABSTRACT

A dish assembly for a burial casket comprises a generally rectangular cap panel having a pair of opposed sides, a puffing member attached to each side of the pair of sides along respective adjacent edges of the puffing member and side, a cap panel insert removably inserted between the puffing members and juxtaposed relative to the cap panel, a tab removably inserted between the respective adjacent edges of each attached puffing member and side, and a first portion of a fastener attached to said tab and a second portion of the fastener attached to the cap panel insert. The first and second portions of the fastener are removably secured one to another such that the cap panel insert is removably secured to the cap panel of the dish assembly. The respective adjacent edges of the puffing members and sides may be secured together with staples. The tab comprises a rectangular portion and two leg portions extending from said rectangular portion. The tab leg portions are removably inserted and retained between the respective adjacent edges of the attached puffing member and side. The space between the tab leg portions accommodates staples therebetween. The fastener may be a hook and loop type fastener.

9 Claims, 2 Drawing Sheets

DISH ASSEMBLY FOR BURIAL CASKET CAP AND METHOD

FIELD OF THE INVENTION

This invention relates generally to burial caskets, and more particularly to dish assemblies for burial casket caps or lids.

BACKGROUND OF THE INVENTION

Burial caskets traditionally comprise a shell to which is pivoted a cap or lid. During viewing of the deceased in the casket, the cap is of course pivoted to its open position to permit relatives, loved ones, acquaintances and the like to view the deceased. During this time the underside of the casket cap is visible. It is thus desirable to trim the underside of the cap with decorative trim. This has been traditionally accomplished with the installation of a dish assembly into the underside of the cap.

The traditional dish assembly has taken the form of a rectangular cap panel having two long sides and two short sides, with a puffing member being attached to each of the four sides. The cap panel is positioned in the casket cap atop a standoff, itself positioned in the cap, or atop a ridge or groove forming a part of the cap. The free edges of the puffing members are retained in a peripheral groove in the casket cap near the peripheral edge of the cap. The puffing members are so sized as to require them to assume a convex shape for their free edges to be retained in the peripheral groove. A rectangular cap panel insert, including decorative embroidery or the like, is installed between the four puffing members and in juxtaposition relative to the cap panel. Friction between the four puffing members and the four side edges of the cap panel insert has been employed to secure the cap panel insert into the dish assembly. This technique has not met with complete satisfaction as, depending on the force with which the cap closes upon the shell, the cap panel insert can become dislodged from the dish assembly and fall upon the deceased.

Other more elaborate means of securing the cap panel insert into the dish assembly have been employed. It is desirable however to employ a means of attachment which permits removable securement of the cap panel insert into the dish assembly to allow various inserts to be presented to a purchaser of the casket. Quite often, a customer will desire to view a number of different inserts in a dish assembly during the casket selection process, with each insert having a different embroidered pattern, or different fabric, thereon. Therefore it is desirable to be able to quickly remove one cap panel insert from the dish assembly of a casket cap and to replace it with another insert for selection purposes. The straps cannot be permanently attached to the insert at both the upper and lower locations as the insert, normally fabricated of a rigid substrate, cannot be flexed or bowed to the extent required to slip the strap ends into place.

One technique for removably installing a cap panel insert into a dish assembly is disclosed in Winburn et al. U.S. Pat. No. 4,357,741, assigned to the assignee of the present invention, and incorporated by reference herein as if fully set forth in its entirety. The Winburn patent discloses the use of a pair of elongated straps secured to a cap panel insert to facilitate installation of the insert into the dish assembly. The straps are spaced along the length of the insert and are fixedly or permanently secured to the insert near the lower ends of the straps. Near the upper ends of the straps the straps are removably secured to the insert via fasteners. The straps are longer than the height of the insert so that a portion of each strap protrudes above and below the top and bottom edges of the insert. To install the insert into a dish assembly, the bottom strap portions are inserted between the cap panel and the bottom puffing. The insert is angled outwardly from the cap, i.e. toward an installer, during which time the upper ends of the straps are not connected to the insert, and the top strap portions are inserted between the cap panel and the top puffing. The straps are flexible enough to allow bowing of the straps to slip the top strap portions into place. The insert is then pivoted into place against the cap panel and the fasteners attached to the insert are fastened to the fasteners attached near the upper ends of the straps.

A difficulty associated with the Winburn technique is that an installer must work over the top edge of the cap panel insert, which is pivoted outwardly and into the face of the installer, to insert and remove the upper strap ends to and from between the cap panel and the top puffing. Thus installation is somewhat awkward and not as swiftly accomplished as would be desired.

It is therefore a main objective of the present invention to provide a dish assembly for a burial casket cap of improved construction which provides quick and easy installation and removal of the cap panel insert into and from the dish assembly and positive retention of the insert in the assembly.

SUMMARY OF THE INVENTION

The present invention attains the stated objective by providing a dish assembly for a burial casket. The dish assembly comprises a generally rectangular cap panel having a pair of opposed sides, a puffing member attached to each side of the pair of sides along respective adjacent edges of the puffing member and side, a cap panel insert removably inserted between the puffing members and juxtaposed relative to the cap panel, a tab removably inserted between the respective adjacent edges of each attached puffing member and side, and a first portion of a fastener attached to the tab and a second portion of the fastener attached to the cap panel insert. The first and second portions of the fastener are removably secured one to another such that the cap panel insert is removably secured to the cap panel of the dish assembly.

The respective adjacent edges of the puffing members and sides may be secured together with staples. The tab comprises a rectangular portion and two leg portions extending from the rectangular portion. The tab leg portions are removably inserted and retained between the respective adjacent edges of the attached puffing member and side. The space between the tab leg portions accommodates staples therebetween.

The fastener may be a hook and loop type fastener. The hook portion of the fastener is attached to one of either the tab and cap panel insert and the loop portion of the fastener is attached to the other of the tab and cap panel insert.

In a preferred form, the generally rectangular cap panel has a pair of opposed long sides and a pair of opposed short sides. A puffing member is attached to each side of the pair of long sides and pair of short sides. A pair of tabs are spaced apart and removably inserted between respective adjacent edges of each attached puffing member and long side.

The present invention also provides a burial casket comprising a shell and a cap pivoted to the shell, with the cap including a dish assembly of the above construction.

The present invention also provides a method of assembling a dish assembly for a burial casket cap. The method comprises the steps of providing a generally rectangular cap panel having a pair of opposed sides, providing at least two puffing members, attaching a puffing member to each of the pair of sides along respective adjacent edges of the puffing member and side, providing at least two tabs each of which has attached thereto a first portion of a fastener, removably inserting a tab between the respective adjacent edges of each attached puffing member and side, providing a cap panel insert having attached thereto a second portion of the fastener, removably inserting the cap panel insert between the puffing members and juxtaposing the cap panel insert relative to the cap panel, and removably securing the first and second fastener portions together thereby removably securing the cap panel insert to the cap panel of the dish assembly.

The main advantage of the present invention is that a dish assembly for a burial casket cap is provided which is of improved construction to permit quick and easy installation and removal of the cap panel insert into and from the dish assembly yet which positively retains the insert in the assembly thus avoiding the difficulties of prior art techniques.

These and other objects and advantages of the present invention will become more readily apparent during the following detailed description taken in conjunction with the drawings herein, in which:

DETAILED DESCRIPTION OF THE INVENTION

Figure 1:
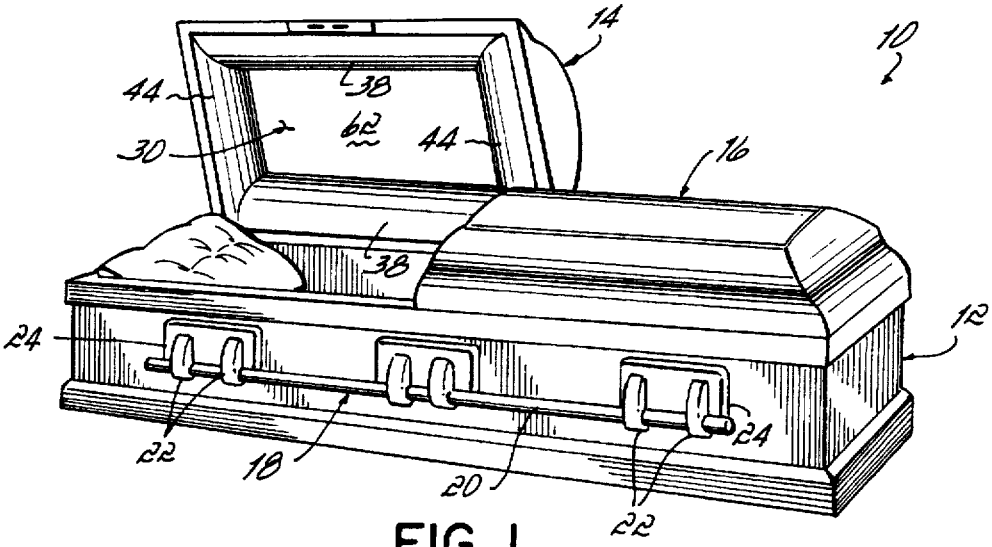
FIG. 1 a perspective view of a burial casket incorporating the dish assembly of the present invention.

Referring first to FIG. 1, there is illustrated a casket 10 incorporating the principles of the present invention. The casket 10 includes a shell 12 to which is pivoted a head end cap 14 and a foot end cap 16. The caps 14 and 16 are pivoted to the shell 12 by conventional means known to those skilled in the art, but not shown in the drawings. Hardware 18 in the form of a handlebar 20 is supported by arms 22 attached to escutcheon plates 24 which are in turn attached to the shell 12. The caps 14 and 16 each include a dish assembly 30 mounted on the underside thereof (only visible in the head end cap 14 in FIG. 1).

The dish assembly 30 includes a generally rectangular cap panel 32 having a pair of opposed long sides 34, 34 and a pair of opposed short sides 36, 36. A puffing member 38 is attached to each long side 34 along respective adjacent edges **40*a*, 40*b* as by staples 42. A puffing member 44 is similarly attached to each short side 36**.

Figure 2:
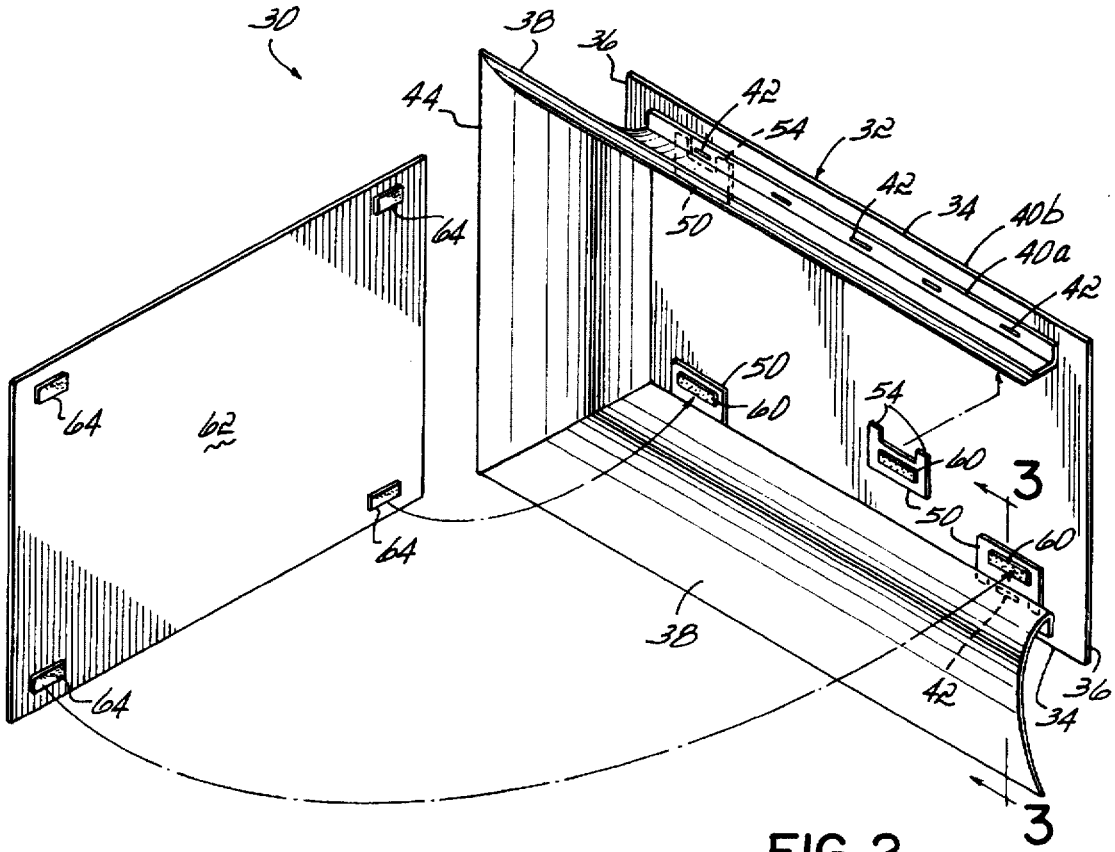
FIG. 2 is a perspective view of the dish assembly of the present invention.
Figure 3:
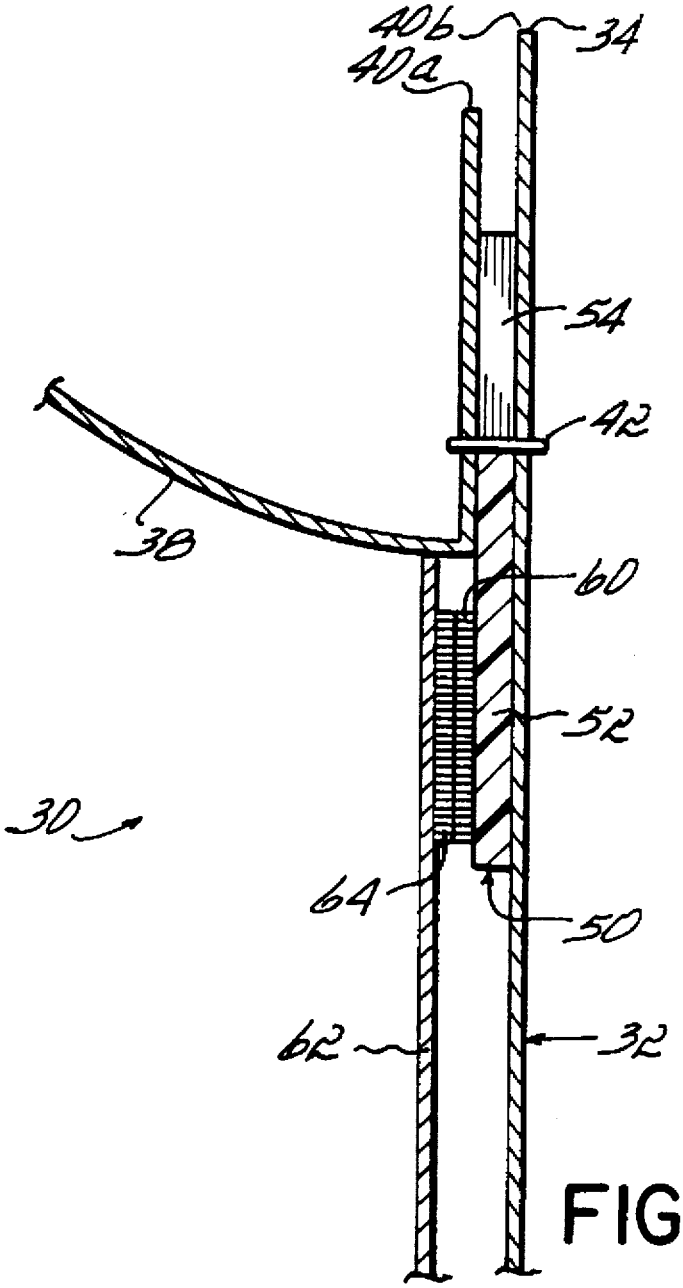
FIG. 3 is a view taken along line 3—3 of FIG. 2.

Tabs 50, fabricated of, for example, plastic, are removably inserted between the respective adjacent edges **40*a*, 40*b* of the attached puffing 32 and side 34. As shown in FIGS. 2 and 3, the tabs 50 comprise a rectangular portion 52 and two leg portions 54 extending from the rectangular portion 52. The tab leg portions 54 are removably inserted and retained between respective adjacent edges 40*a*, 40*b* of the attached puffing member 38 and side 34, as best shown in FIG. 3. The space between the tab leg portions 54 accommodates staples 42 therebetween. Tab 50 includes a first portion 60** of a hook and loop type fastener, for example VELCRO®, secured thereto as by adhesives or the like.

A rectangular cap panel insert 62 includes a plurality of second portions 64 of the hook and loop type fasteners secured thereto also as by adhesives or the like.

To assemble the dish assembly 18, the puffing members 38 and 44 are first stapled to the sides 34 and 36, respectively, along respective adjacent edges **40*a*, 40*b* with staples 42. Next, a pair of tabs 50 are inserted between each of the upper and lower attached puffings 38 and cap panel sides 34. The legs 54 of the tabs 50 are positioned so as to receive therebetween a staple 42 securing the puffings 38 to the sides 34. Preferably the portions 60 of the hook and loop type fasteners have been preattached to the tabs 50, as have been the portions 64 preattached to the cap panel insert 62. The cap panel insert 62 is then removably inserted between the puffing members 38 and 44 and is placed in juxtaposition relative to the cap panel 32, at which time the first and second portions 60 and 64** of the hook and loop type fasteners are removably secured one to another.

To remove the insert 62 and replace it with one of a different design, the insert 62 is simply separated from each of the tabs 60 at the four points of attachment, and a different insert 62 is inserted between the puffings 38 and 44 and into juxtaposition with the cap panel 32.

Those skilled in the art will readily recognize numerous adaptations and modifications which can be made to the present invention which will result in an improved dish assembly for a burial casket cap, yet all of which will fall within the spirit and scope of the present invention as defined in the following claims. Accordingly, the invention is to be limited only by the scope of the following claims and their equivalents.

What is claimed is:

1. A dish assembly for a burial casket cap comprising:

a generally rectangular cap panel having a pair of opposed sides;

a puffing member attached to each side of said pair of sides along respective adjacent edges of said puffing member and side;

a cap panel insert having a pair of opposed sides corresponding to said cap panel opposed sides removably inserted between said puffing members and juxtaposed relative to said cap panel;

a pair of tabs, one tab of said pair being removably inserted between said respective adjacent edges of each said attached puffing member and cap panel side; and a first portion of a removably securable fastener attached to each said tab and a second portion of said fastener attached to each opposed side of said cap panel insert;

whereby when said tabs are inserted between said respective adjacent edges of each said attached puffing member and cap panel side said first and second portions of said fasteners can then be removably secured one to another such that said cap panel insert is removably secured to said cap panel of said dish assembly.

2. The dish assembly of claim 1 wherein:

said respective adjacent edges of said puffing members and sides are secured together with staples; and said tab comprises a rectangular portion and two leg portions extending from said rectangular portion;

said tab leg portions being removably inserted and retained between said respective adjacent edges of said attached puffing member and side, the space between said tab leg portions accommodating staples therebetween.

3. The dish assembly of claim 2 wherein said fastener is a hook and loop type fastener, the hook portion of said fastener being attached to one of said tab and cap panel insert and the loop portion of said fastener being attached to the other of said tab and cap panel insert.

4. The dish assembly of claim 3 wherein:

said generally rectangular cap panel has a pair of opposed long sides and a pair of opposed short sides;

a puffing member is attached to each side of said pair of long sides and pair of short sides; and a pair of tabs are spaced apart and removably inserted between respective adjacent edges of each said attached puffing member and long side.

5. A burial casket comprising a shell and a cap pivoted to said shell, said cap including a dish assembly comprising:

a generally rectangular cap panel having a pair of opposed sides;

a puffing member attached to each side of said pair of sides along respective adjacent edges of said puffing member and side;

a cap panel insert having a pair of opposed sides corresponding to said cap panel opposed sides removably inserted between said puffing members and juxtaposed relative to said cap panel;

a pair of tabs, one tab of said pair being removably inserted between said respective adjacent edges of each said attached puffing member and cap panel side; and a first portion of a removably securable fastener attached to each said tab and a second portion of said fastener attached to each opposed side of said cap panel insert;

whereby when said tabs are inserted between said respective adjacent edges of each said attached puffing member and cap panel side said first and second portions of said fasteners can then be removably secured one to another such that said cap panel insert is removably secured to said cap panel of said dish assembly.

6. The burial casket of claim 5 wherein:

said respective adjacent edges of said puffing members and sides are secured together with staples; and said tab comprises a rectangular portion and two leg portions extending from said rectangular portion;

said tab leg portions being removably inserted and retained between said respective adjacent edges of said attached puffing member and side, the space between said tab leg portions accommodating staples therebetween.

7. The burial casket of claim 6 wherein said fastener is a hook and loop type fastener, the hook portion of said fastener being attached to one of said tab and cap panel insert and the loop portion of said fastener being attached to the other of said tab and cap panel insert.

8. The burial casket of claim 7 wherein:

said generally rectangular cap panel has a pair of opposed long sides and a pair of opposed short sides;

a puffing member is attached to each side of said pair of long sides and pair of short sides; and a pair of tabs are spaced apart and removably inserted between respective adjacent edges of each said attached puffing member and long side.

9. A method of assembling a dish assembly for a burial casket cap comprising the steps of:

providing a generally rectangular cap panel having a pair of opposed sides;

providing at least two puffing members;

attaching a puffing member to each of the pair of sides along respective adjacent edges of the puffing member and side;

providing at least two tabs each of which has attached thereto a first portion of a fastener;

removably inserting one of the tabs between the respective adjacent edges of each attached puffing member and side;

providing a cap panel insert having a pair of opposed sides corresponding to the cap panel opposed sides, each of the cap panel insert opposed sides having attached thereto a second portion of the fastener;

removably inserting the cap panel insert between the puffing members and juxtaposing the cap panel insert relative to the cap panel; and removably securing the first and second fastener portions together thereby removably securing the cap panel insert to the cap panel of the dish assembly.

* * * * *